US005425313A

United States Patent [19]

Rowan

[11] Patent Number: 5,425,313

[45] Date of Patent: Jun. 20, 1995

[54] CONVERTIBLE TABLE

[76] Inventor: Thomas J. Rowan, 380 Oregon St. #302, Cincinnati, Ohio 45202

[21] Appl. No.: 93,082

[22] Filed: Jul. 16, 1993

[51] Int. Cl.[6] ..... A47B 1/00

[52] U.S. Cl. ..... 108/65; 108/140

[58] Field of Search ..... 108/69, 63, 150, 59, 108/65, 66, 86, 139, 70, 140, 143, 17, 142

[56] References Cited

U.S. PATENT DOCUMENTS

| | | | |
|---|---|---|---|
| 1,342,481 | 6/1920 | Wennerstrom | 108/86 |
| 1,475,401 | 11/1923 | Leatherman et al. . | |
| 1,729,221 | 9/1929 | Krema . | |
| 1,742,904 | 1/1930 | Fullmer . | |
| 1,777,603 | 10/1930 | Starker . | |
| 1,963,467 | 6/1934 | Keller | 108/142 X |
| 2,132,515 | 10/1938 | Oppenheimer . | |
| 2,293,496 | 8/1942 | Egger | 108/140 X |
| 2,468,473 | 4/1949 | Underwood . | |
| 2,605,153 | 7/1952 | Lietz | 108/140 X |
| 2,680,661 | 6/1954 | Bremer . | |
| 2,891,679 | 6/1959 | Maupin | 108/140 X |
| 3,224,391 | 12/1965 | Cooper | 108/140 |
| 4,365,561 | 12/1982 | Tellier et al. | 108/142 X |

FOREIGN PATENT DOCUMENTS

| | | |
|---|---|---|
| 57438 | 4/1940 | Denmark . |
| 81621 | 1/1957 | Denmark . |
| 1236888 | 6/1960 | France . |
| 83934 | 3/1895 | Germany . |
| 52-43294 | 4/1977 | Japan . |
| 288354 | 1/1953 | Switzerland . |
| 409305 | 5/1934 | United Kingdom . |

*Primary Examiner*—José V. Chen
*Attorney, Agent, or Firm*—Wood, Herron & Evans

[57] ABSTRACT

A convertible table for forming an expanded table surface area. The convertible table is comprised of overlying and underlying table members which are connected by a pivot pin. The underlying table member is capable of sliding along a member connected to the table support to center the weight of the expanded table after rotation of the overlying table member. The construction of the converting mechanism permits the overlying and underlying table members to be formed in a variety of shapes.

30 Claims, 3 Drawing Sheets

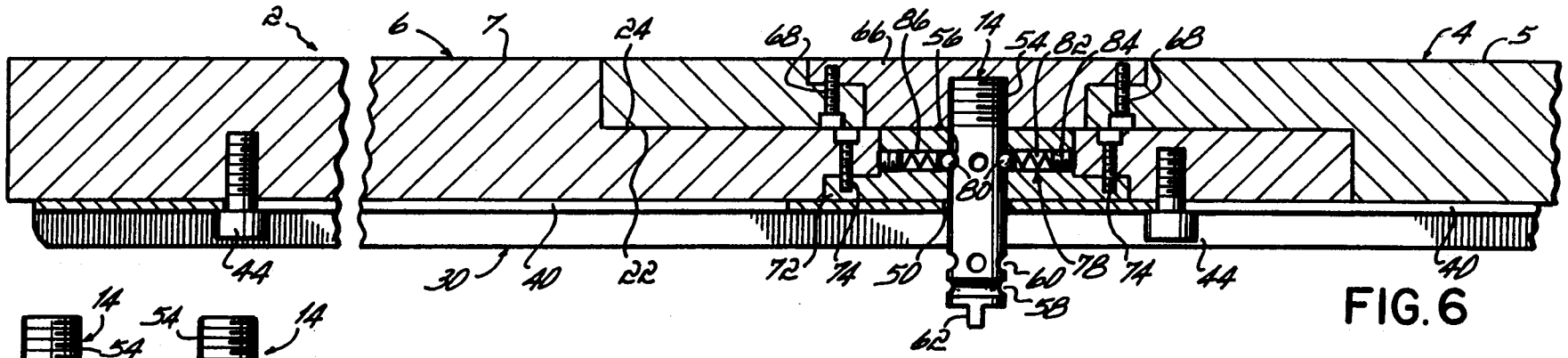
FIG. 6
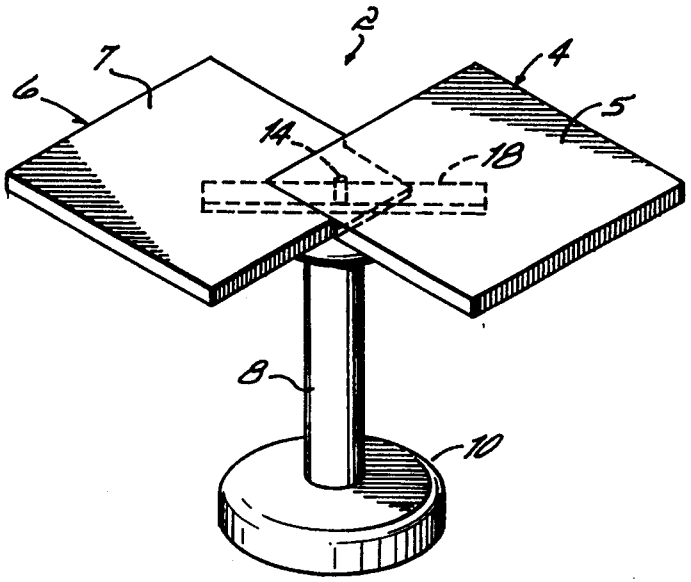
FIG. 9
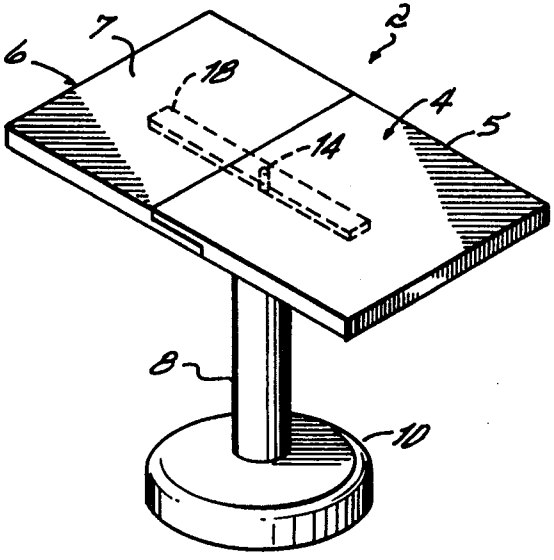
FIG. 8
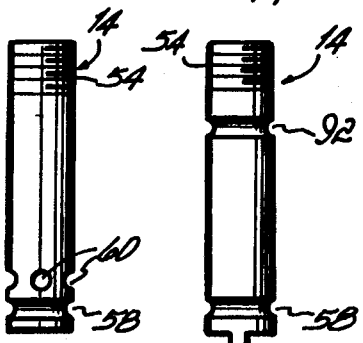
FIG. 7A
FIG. 7B
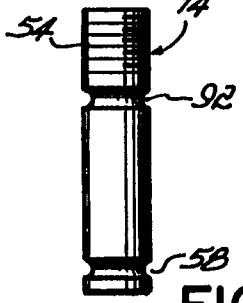
FIG. 7C

CONVERTIBLE TABLE

FIELD OF THE INVENTION

The invention relates to an improved table construction which permits expansion of the usable table surface by rotation of an overlying table member relative to an underlying table member and centering the expanded table surface over the support means for the table.

BACKGROUND OF THE INVENTION

In commercial restaurant applications, but also in the home environment, there arises the need on occasion to expand available table capacity to accommodate additional diners. When this need arises, one manner of addressing the problem is merely to employ an additional table or tables from a storage area. However, this option initially requires the purchase of the additional tables which will be used only occasionally, and further requires that there be sufficient space to store these tables when not in use. Alternatively, certain tables converted from a first surface area to a larger surface area by adding additional leaves to the table, typically accomplished by opening the table to expose a gap which can receive one or more of the leaves. Again, however, the leaves must be purchased and stored. As a further alternative, the available table surface area can be increased by use of convertible tables having double thickness table surface members which are hinged along one end to allow the member to be opened, thereby exposing the additional table surface. This last type of convertible table requires a secure attachment along the hinge line to permit repeated openings without breakage, and requires additional means to provide support for the opened section. In all the above examples, the expanded table surface is typically limited to a rectangular shape because of the restraints in constructing these types of convertible tables.

SUMMARY OF THE INVENTION

The invention relates to an improved convertible table construction which can provide an expanded table surface area. The table of the invention comprises supported overlying and underlying table members which are connected together through a pivot pin, permitting the overlying table member to be rotated relative to the underlying member to expose the table surface of the underlying member. The pivot pin is positioned a distance away from the center of gravity of the overlying and underlying table members, typically adjacent an edge, so that the rotation is able to advantageously expose the maximum amount of additional surface area of the underlying member. After the overlying table member is rotated, the expanded table surface no longer has its weight centered over the support. To remedy this, the underlying table member is moved along slider means attached to the support so that the weight of the expanded table surface is once again centered over the support.

The respective overlying and underlying table members typically have the same shape and dimension. The most aesthetically pleasing appearance for the expanded table is a flush surface. To achieve this, the upper surface of the underlying table member in the vicinity of the pivot pin and the corresponding lower surface of the overlying table member in the vicinity of the pin are constructed in such a manner that, when the overlying table member is rotated to a predetermined point between 0 and 180 degrees of rotation, typically 180 degrees, the overlying table member is able to drop into position over the mating underlying table member section to generate a flush expanded table surface. However, full downward travel of the pivot pin is prevented due to a restriction all along the slider means attached to the support, except at the center of the slider means. This restriction, except at the center, aids in guiding the weight of the expanded table surface to a centered position over the support to optimize stability. At the center point is an aperture having a diameter which will accept the pivot pin and permit full downward travel. When the expanded table is slid along the slider means to that point where the pivot pin is over the aperture at the center of gravity, the pin will drop through the aperture, creating the flush surface appearance, and also centering the expanded table surface weight.

The overlying table member is restrained from rotating freely about the pivot pin by an apparatus system comprised of detent cavities formed in the pivot pin which mate with restraining members directed inwardly from the periphery of the aperture in the underlying table member. One such type of restraining member is a ball plunger which applies an inward force on a ball bearing from a mounted spring to engage a single detent cavity in the pivot pin. At least one such restraining member should be used when restricting rotation of the pivot pin in this manner. Typically, four restraining members such as the ball plungers mentioned above are directed into the aperture to engage mating detent cavities in the pivot pin. Alternatively, rotation is restricted away from the pivot pin by mating magnets or by lock means in the overlying and underlying table members, which are released prior to rotation.

Because the overlying and underlying table members are joined at a single point, the convertible table of this invention can have a variety of shapes, such as round, square, rectangular, oval, polygonal and the like. Also, the overlying and underlying table members can be produced from a variety of materials, including but not limited to wood, metal, acrylic, laminates, and others. The invention is believed to be particularly beneficial for use in restaurants known typically as "bistros" wherein it is desired to have a number of smaller surface area round tables supported on a single base and pedestal.

The convertible table of this invention not only can be used with table surfaces having a variety of shapes, but also provides expanded table surface area at a reduced cost relative to non-convertible tables.

Therefore, it is an object of the invention to provide a convertible table which can easily expand in table surface area.

It is a further object of the invention to provide a convertible table having a variety of table member shapes.

It is yet a further object of the invention to provide a convertible table which has an expanded table surface supportable on a single pedestal and base.

These and other objects and advantages of the invention will become readily apparent from the following detailed description of a preferred embodiment of the invention and from the drawings in which:

BRIEF DESCRIPTION OF THE DRAWINGS

FIG. 6 is a cross-sectional view similar to FIG. 4 showing the pivot pin in relation to the underlying and overlying table members with the table surface in the opened position.

FIGS. 7A, 7B and 7C are alternative embodiments of the pivot pin.

FIG. 8 is a perspective drawing of an alternative table surface shape, in the opened position.

FIG. 9 is a perspective drawing of yet another alternative table surface shape, in the opened position.

DETAILED DESCRIPTION OF THE INVENTION

In its broader aspects, the invention relates to a table having a surface which is convertible from a first surface area to a larger second surface area comprising support means for supporting a table surface; an underlying table member having a table surface thereon and a receptacle therein; an overlying table member having a table surface thereon and a receptacle therein, positionable above the underlying table member; and a pivot pin inserted into the receptacle in the overlying table member and the receptacle of the underlying table member to allow rotation of the overlying table member relative to the underlying table member to thereby expose at least a portion of the table surface of the underlying table member. Where the table surface is supported by a pedestal and base arrangement or other related support frame, the table further includes slider means connected to the support means which permit the underlying table member to move translationally along the slider means to center the weight of the larger second surface area over the support means to minimize the risk of tipping.

Figure 1:
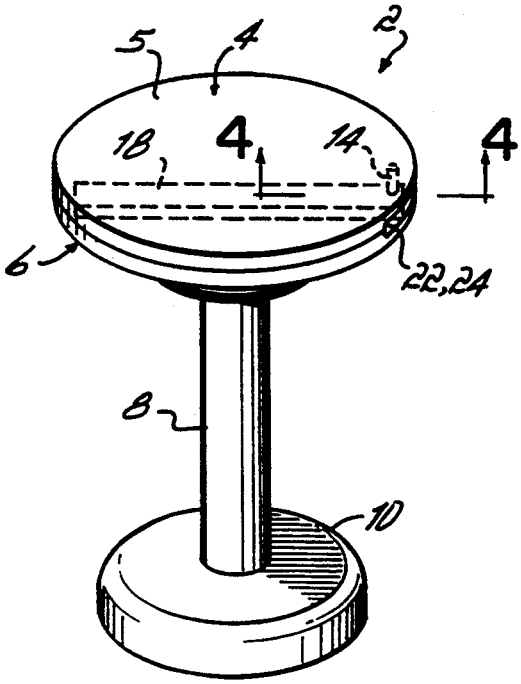
FIG. 1 is a perspective drawing of an embodiment of the convertible table with the table surfaces in the closed position.
Figure 2:
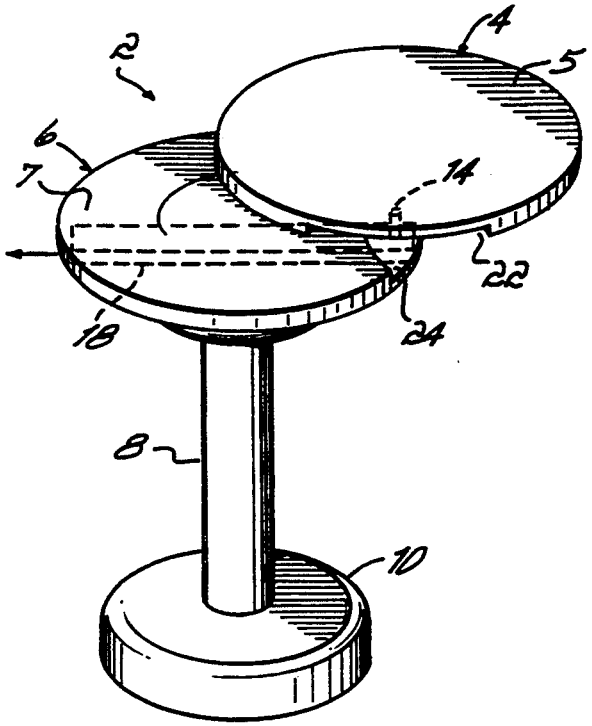
FIG. 2 is a perspective drawing of an embodiment of the convertible table with the table surfaces in a partially opened position.
Figure 3:
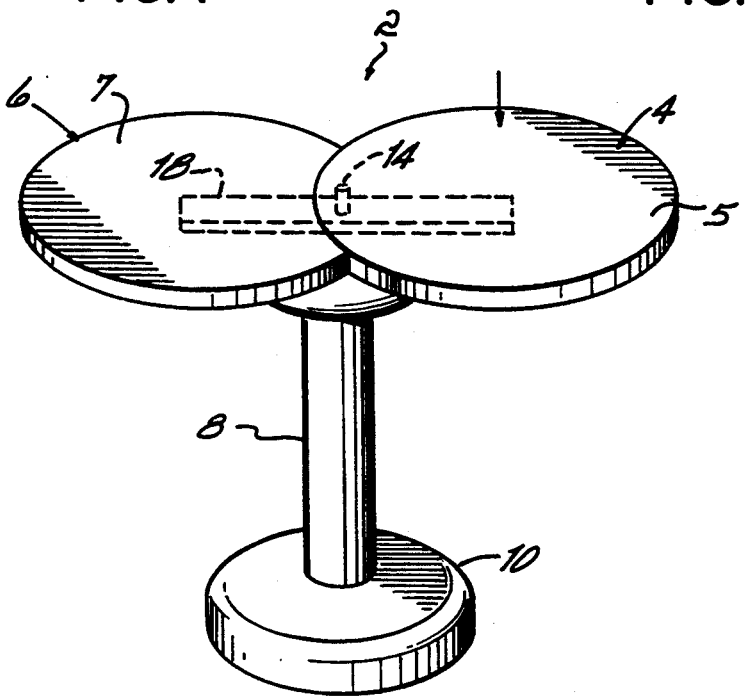
FIG. 3 is a perspective drawing of an embodiment of the convertible table with the table surfaces in the open position.

Referring to the drawings, FIGS. 1, 2 and 3 show the convertible table 2 comprised of an overlying table member 4 with table surface 5, underlying table member 6 with table surface 7, pedestal 8 and base 10. The overlying table member 4 and underlying table member 6 are connected via a pivot pin 14, shown in broken lines in FIGS. 1, 2 and 3 and described in more detail below. The underlying table member 6 is connected to the pedestal 8 via slider means 18, shown in broken lines in FIGS. 1, 2 and 3 and also described in more detail below.

FIGS. 2 and 3 show respectively the convertible table 2 during the process of rotating the overlying table member 4 relative to the underlying table member 6 to form a table having a larger second table surface area. As discussed further herein, the table will be described as "closed" when the overlying table member 4 and underlying table member 6 lie one over the other, as in FIG. 1.; "open" as shown in FIG. 3; and in "transition" i.e. in the process of being opened, as shown generally in FIG. 2.

It is desirable to have the respective overlying table member 4 and underlying table member 6 display a flush larger table surface area. To accomplish this, mating portions of the overlying table member 4 and underlying table member 6 are partially cut away so that when the overlying table member 4 is rotated to the open position, its table surface 5 will be able to lie flush with the table surface 7 of underlying table member 6. The cutaway portions 22 and 24 of overlying table member 4 and underlying table member 6 respectively, are shown in FIG. 2, and also in more detail in FIGS. 4, 5 and 6, discussed below.

Figure 4:
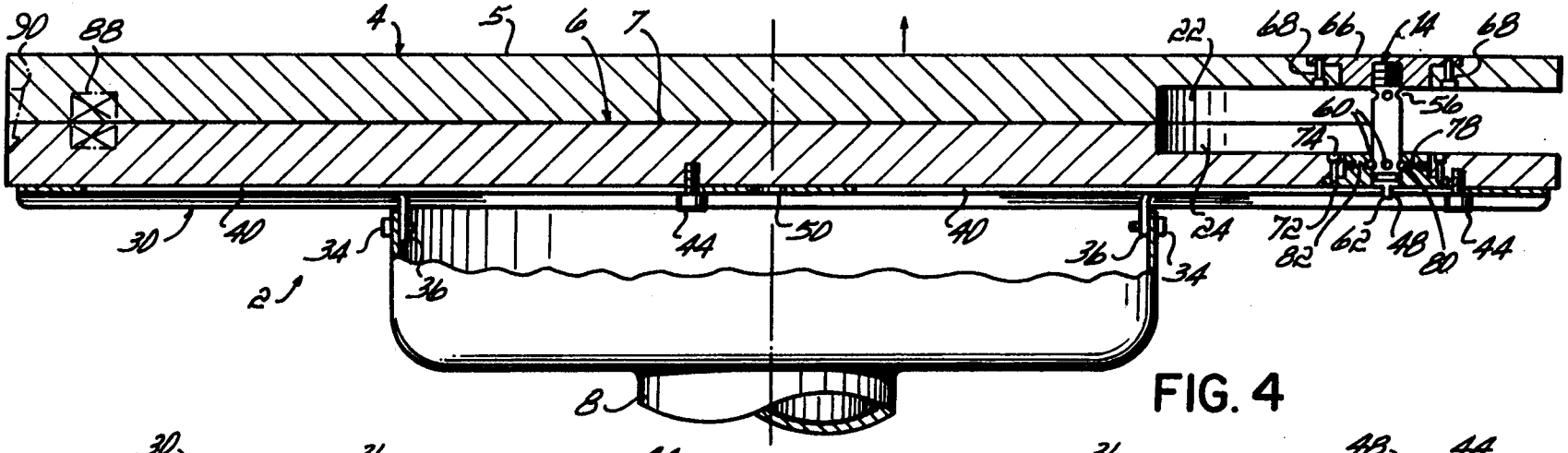
FIG. 4 is a cross-sectional view taken on lines 4—4 of FIG. 1 depicting the underlying and overlying table members, the connecting pivot pin, the slider means and support means.

FIG. 4 shows the convertible table 2 in the closed position, with overlying table member 4 positioned directly above underlying table member 6. The underlying table member 6 is attached to the pedestal 8 through slider means such as a channel member 30. The channel member 30 is secured to the pedestal 8 by screws 34 fastened through the pedestal 8 and channel member tabs 36.

Figure 4A:
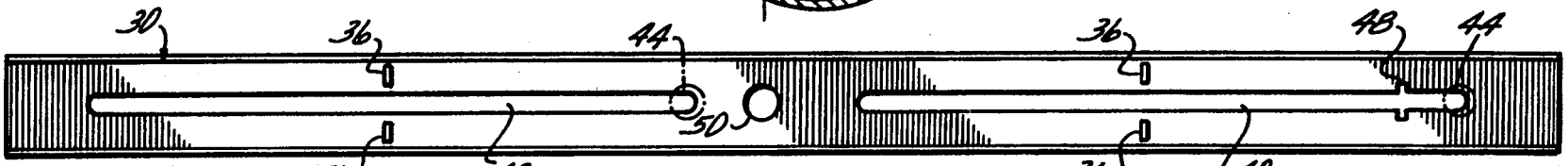
FIG. 4A is a bottom view of the channel member used as a slider means.

As depicted in FIGS. 4 and 4A, the channel member 30 has two slots 40 which receive anchor screws 44 which in turn are driven into the under side of the underlying table member 6 sufficient to retain the underlying table member 6 on the channel member 30, but with enough free play to allow the anchor screws 44 to slide in the slots 40. The heads of anchor screws 44 have a diameter larger than the transverse gap in slots 40 to insure that the underlying table member 6 remains securely connected to the pedestal 8. At the center of channel member 30 is an aperture 50 which has a diameter greater than that of pivot pin 14. One of the slots 40 also has a transverse slot 48, which serves to mate with the pivot pin 14, as discussed in more detail below.

Figure 5:
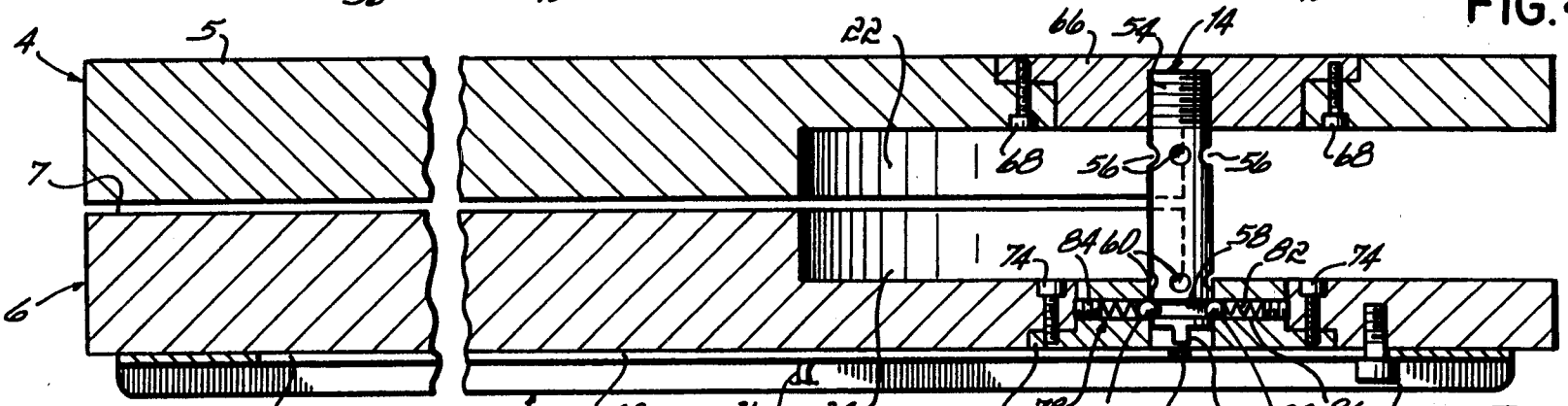
FIG. 5 is a cross-sectional view similar to FIG. 4 showing the pivot pin in relation to the underlying and overlying table members with the table surface in the closed position.

As is shown in FIG. 5, one embodiment of the pivot pin 14 has a threaded end 54, at least one upper detent cavity 56, a race 58 and at least one detent cavity 60 between the upper detent cavity 56 and race 58. At the end opposite the threaded end 54 is a projection 62. The projection has a length essentially equal to the diameter of the first pin 14, but a narrow width, which allows it to mate with the transverse slot 48 of channel member 30. The pivot pin 14 is secured into the overlying table member 4 by inserting the threaded end 54 of the pivot pin 14 into a mating threaded portion of an upper bushing 66 which is secured into table member 4 by flush mounted upper bushing screws 68. The pivot pin 14 is connected to the underlying table member 6 via insertion into lower bushing 72 which in turn is secured into underlying table member 6 by flush mounted lower bushing screws 74. The upper bushing 66 is depicted as spanning the entire thickness of the overlying table member 4 in the vicinity of the pivot pin 14. Such a bushing 66 is necessary for overlying table members 4 constructed from certain materials or where the overlying table member 4 is of a heavier weight. Where it is desired to display a smooth uninterrupted table surface 5, the upper bushing 66 can terminate within the overlying table member 4 at a point below the table surface 5. The bushing 66 may be of smaller dimension, and have a different shape, such as a square receptacle with or without fastening screws only slightly larger than the diameter of the pivot pin 14.

As shown in FIGS. 4, 5 and 6, the lower bushing 72 preferably includes at least one restraining member, such as the ball plunger 78 comprised of a ball 80, a spring 82 and a threaded tensioning device 84 to adjust the spring tension, all located within a bore 86. Bore 86 has threads on the outermost section. The balls 80 are able to be forced into one or more detent cavities 56 or 60. To rotate the overlying table member 4 relative to the underlying table member 6 during transition from closed to open position, the inwardly-directed force on the balls 80 supplied by springs 82 into detent cavities 60 in FIG. 4 must be overcome, both vertically and radially. The spring tension is adjustable by means of the tensioning devices 84 traveling in the threaded sections of bores 86, shown in detail in FIGS. 5 and 6.

To rotate the overlying table member 4 relative to underlying table member 6, the pivot pin 14 is raised within lower bushing 72 so that the lower detent cavities 60 clear the balls 80 and the balls 80 make contact with the race 58, as shown in FIG. 5. At the same time projection 62 will disengage from transverse slot 48 of slot 40 of channel member 30. With the pivot pin 14 in this position, the overlying table member 4 and underlying table member 6 break contact with each other and the overlying table member 4 can be freely rotated during transition without any contact between the overlying table member 4 and the table surface 7 of underlying table member 6.

When the overlying table member 4 is opened to the appropriate position, typically at 180 degrees of rotation of the pivot pin 14, the cutaway portions 22 and 24 respectively of overlying table member 4 and underlying table 6 come into mating alignment (see FIGS. 3 and 6). In this, the open position, the table surface 5 of overlying table member 4 can be brought into flush relation with table surface 7 of the underlying table member 6. This is accomplished by guiding the pivot pin 14 and overlying table member 4 downwardly so that the balls 80 clear both the race 58 and lower detent cavities 60, and engage the upper detent cavities 56. In this position, the rotation of pivot pin 14 is restricted not only by the flush relationship of cutaway portions 22 and 24, but also by the restraining force of balls 80 in the upper detent cavities 56. Where the overlying and underlying table members 4 and 6 are manufactured to very close tolerances, there is essentially no movement of the overlying table member 4 relative to the underlying table member 6 in the open position, independent of the contribution from the contact of balls 80 into upper detent cavities 56.

As shown in FIG. 6 when the pivot pin 14 is lowered relative to the lower bushing 72, the lower portion of the pivot pin 14 is able to extend below the channel member 30. However, the slots 40 are not wide enough to accept the diameter of the pivot pin 14. When pivot pin 14 is positioned over either of the slots 40, the pivot pin 14 cannot travel downward to its full extent, preventing the flush positioning of table surfaces 5 and 7 of the overlying table member 4 and underlying table member 6 respectively. Flush positioning of the table surfaces 5 and 7 can be accomplished only by sliding the underlying table member 6 along channel member 30 until the pivot pin 14 is aligned over the aperture 50 in the channel member 30. Preferably, the anchor screws 44 are so fastened into the under side of underlying table member 6 that the pivot pin 14 will be in alignment over the aperture 50 when the anchor screws 44 make contact with the ends of slots 40, as shown in FIGS. 4A and 6. As the pivot pin 14 drops through aperture 50, the upper detent cavity 56 comes into contact with balls 80 to restrict further radial and vertical movement of the overlying table member 4. By locating the aperture 50 of channel member 30 in a centered position over the pedestal 8 and base 10, the larger second table surface area will have its weight centered over the pedestal 8 and base 10, thus minimizing the risk of tipping the table.

FIGS. 7A, 7B and 7C show alternate embodiments for the pivot pin 14. In FIG. 7A, the pivot pin 14 is similar in configuration to that version shown in FIGS. 4, 5 and 6, except that the projection 62 and upper detent cavities 56 are deleted. Upper detent cavities 56 are not needed where the flush relationship of the overlying and underlying table members 4 and 6 results in minimal free play between the table members. The projection 62, which serves to lock overlying table member 4 in a single position when the table is in closed position, is not as necessary a component where the overlying and underlying table members 4 and 6 have smaller dimension. There would already be provided the restraining effect of contact between lower detent cavities 60 with balls 80 in the FIG. 7A embodiment to maintain the closed position. Further, other means for locking the overlying table member 4 in place away from the pivot pin 14 can be used. Thus, in addition to the restraining effect of the contact between lower detent cavities 60 with balls 80, a lock 90 spanning overlying and underlying table members 4 and 6, or magnets 88, both as shown in broken lines in FIG. 4, can optionally be employed. One such lock 90 can be a thumb latch. The pivot pin 14 of FIG. 7B has no detent cavities at all. Thus a lock 90 or magnet 88 can be used in conjunction with this pivot pin embodiment, keeping in mind that the projection 62 will lock the overlying table member 4 in the closed position, and the flush relationship of overlying and underlying table members 4 and 6 will maintain the larger surface area table in the open position. The pivot pin 14 embodiment in FIG. 7C would require a lock 90 or magnet 88 to hold the overlying and underlying table members 4 and 6 in the closed position because of the absence of the projection 62 and lower detent cavities 60.

Other embodiments for the pivot pin 14 are possible, and are dictated by the features desired. Generally, the projection 62 mating with transverse slot 48 locks the table in closed position. Lower detent cavities 60 restrain movement from the closed position, but do allow movement to occur. Upper detent cavities 56 restrain movement once the open position is attained, but this may not be necessary if the tolerances on the underlying and overlying table members are sufficiently close to minimize relative movement in the flush relationship. The race 58 should be incorporated where it is desired to eliminate contact between the overlying table number 4 and the table surface 7 of underlying table number 6 during transition. An upper race 92, shown in FIGS. 7B and 7C, can be used in place of upper detent cavities 56 where the flush relationship between overlying and underlying table members 4 and 6 results in minimal relative movement about the pivot pin 14, but where it is also desired to restrain vertical movement of the overlying table member 4.

FIGS. 8 and 9 depict alternative designs for convertible tables 2, FIG. 8 depicting an expanded rectangular shape based on two smaller rectangular table members, and FIG. 9 depicting a double diamond effect, again based on two smaller rectangular table members.

The overlying table member 4 and underlying table member 6 may be manufactured from any of a variety of materials, such as wood, engineering plastics such as polycarbonate, other polymeric materials, laminated products, as well as other materials able to be used as a table surface. The pivot pin 14 and various fastening screws disclosed herein have been satisfactorily produced from stainless steel but other materials, such as brass or other metals can be used. Combinations of different materials can be used also. It is also anticipated that, though the embodiment shown in the drawings depicts a support means of a single pedestal and base, it is anticipated that other types of frames, such as a more conventional four-leg table frame with a channel member 30 secured thereon, or frames using traditional table leg configurations in, for example, the Early American style, would also be useful.

It is also contemplated that the respective overlying and underlying table members 4 and 6 can be connected via pivot pin 14 in a manner such that the pivot pin 14 is secured into the underlying table member 6, with the restraining member located in the overlying table member 4. The pivot pin 14 in a convertible table so constructed would not be able to drop into a centered aperture below the underlying table member 6, but the table members could still slide along a slider means or remain off-center after attaining the open position, so long as the support could maintain the expanded surface in position without tipping.

Having described this invention and its operating parameters, variations may be achieved without departing from the spirit and scope hereof.

What is claimed is:

1. A table having a surface which is convertible from a first surface area to a larger second surface area comprising:

support means for supporting a table surface;

slider means connected to said support means;

an underlying table member having a table surface thereon and a receptacle therein, said underlying table member connected to and capable of moving translationally along said slider means;

an overlying table member having a table surface thereon and a receptacle therein, positionable above said underlying table member; and, a pivot pin inserted into said receptacle in said overlying table member and said receptacle of said underlying table member to allow rotation of said overlying table member relative to said underlying table member to thereby expose at least a portion of said table surface of said underlying table member, wherein portions of said underlying and overlying table members adjacent said pivot pin are constructed in a manner that said table surface of said overlying table member will lie flush with said table surface of said underlying table member when said pivot pin has rotated to at least one position between 0 and 180 degrees of rotation.

2. The table of claim 1 wherein said receptacle in said underlying table member is an aperture.

3. The table of claim 2 further wherein said slider means is a channel member.

4. The table of claim 3 further wherein said channel member has an aperture centered over said support means, said aperture capable of receiving said pivot pin.

5. The table of claim 2 further wherein said aperture of said underlying table member is defined by a bushing secured into said underlying table member.

6. The table of claim 5 further including at least one restraining member extending inwardly from said bushing into said aperture to contact said pivot pin and thereby restrain rotation of said pivot pin.

7. The table of claim 6 further wherein said pivot pin has at least one detent cavity thereon, said detent cavity capable of mating with said restraining member.

8. The table of claim 6 further wherein said restraining member is a ball plunger.

9. The table of claim 5 further wherein said receptacle in said overlying table member is a bushing.

10. The table of claim 1 further wherein said pivot pin includes a circumferential groove capable of mating with said restraining member to facilitate rotation of said overlying table member.

11. The table of claim 1 further comprising locking means between said underlying and overlying table members away from said pivot pin to prevent rotation of said overlying table member.

12. The table of claim 1 further wherein said support means is a single pedestal attached to a base.

13. A table having a surface which is convertible from a first surface area to a larger second surface area comprising:

support means for supporting a table surface;

an underlying table member having a table surface thereon and a receptacle therein;

an overlying table member having a table surface thereon, defining a first surface area, and a receptacle therein, positionable above said underlying table member; and a pivot pin inserted into said receptacle in said overlying table member and said receptacle of said underlying table member to allow rotation of said overlying table member relative to said underlying table member to thereby expose at least a portion of said table surface of said underlying table member to create a larger second surface area, said larger second surface area comprising the table surface of said overlying table member and at least a portion of the table surface of said underlying table member in flush relationship.

14. The table of claim 13 wherein said receptacle in said underlying table is an aperture.

15. The table of claim 14 further wherein said aperture of said underlying table member is defined by a bushing secured into said underlying table member.

16. The table of claim 14 further including at least one restraining member extending inwardly from said bushing into said aperture to contact said pivot pin and thereby restrain rotation of said pivot pin.

17. The table of claim 16 further wherein said pivot pin has a circumferential groove which is capable of mating with said restraining member to facilitate rotation of said overlying table member.

18. A table having a surface which is convertible from a first surface area to a larger second surface area comprising:

support means for supporting a table surface;

slider means connected to said support means;

an underlying table member having a table surface thereon and a receptacle therein, said underlying table member connected to and capable of moving translationally along said slider means;

an overlying table member having a table surface thereon and a receptacle therein, positionable above said underlying table member; and, a pivot pin inserted into said receptacle in said overlying table member and said receptacle of said underlying table member to allow rotation of said overlying table member relative to said underlying table member to thereby expose at least a portion of said table surface of said underlying table member, wherein said at least a portion of said table surface of said underlying table member is exposed and said underlying and overlying table members are centered over said support means.

19. The table of claim 18 wherein said receptacle in said underlying table member is an aperture.

20. The table of claim 19 further wherein said slider means is a channel member.

21. The table of claim 20 further wherein said channel member has an aperture centered over said support means, said aperture capable of receiving said pivot pin.

22. The table of claim 19 further wherein said aperture of said underlying table member is defined by a bushing secured into said underlying table member.

23. The table of claim 22 further including at least one restraining member extending inwardly from said bushing into said aperture to contact said pivot pin and thereby restrain rotation of said pivot pin.

24. The table of claim 23 further wherein said pivot pin has at least one detent cavity thereon, said detent cavity capable of mating with said restraining member.

25. The table of claim 23 further wherein said restraining member is a ball plunger.

26. The table of claim 22 further wherein said receptacle in said overlying table member is a bushing.

27. The table of claim 18 further wherein said pivot pin includes a circumferential groove capable of mating with said restraining member to facilitate rotation of said overlying table member.

28. The table of claim 18 further comprising locking means between said underlying and overlying table members away from said pivot pin to prevent rotation of said overlying table member.

29. The table of claim 18 further wherein said support means is a single pedestal attached to a base.

30. The table of claim 18 wherein portions of said underlying and overlying table members adjacent said pivot pin are constructed in a manner that said table surface of said overlying table member will lie flush with said table surface of said underlying table member when said pivot pin has rotated to at least one position between 0 and 180 degrees of rotation.

* * * * *